US005113201A

United States Patent [19]

Mano et al.

[11] Patent Number: 5,113,201

[45] Date of Patent: May 12, 1992

[54] THERMAL TRANSFER RECORDING APPARATUS FOR CONTROLLING PRINTING DENSITY WITH THE TEMPERATURE AT THE POSITION WHERE THE INK RIBBON AND PAPER ARE SEPARATED

[75] Inventors: Shigeru Mano; Tatsuichi Maehashi; Kunihiro Koshizuka; Takao Abe, all of Hino, Japan

[73] Assignee: Konica Corporation, Tokyo, Japan

[21] Appl. No.: 674,572

[22] Filed: Mar. 25, 1991

[30] Foreign Application Priority Data

Mar. 30, 1990 [JP] Japan ..... 2-85161

[51] Int. Cl.[5] ..... B41J 2/325

[52] U.S. Cl. ..... 346/76 PH

[58] Field of Search ..... 346/76 PH; 400/120

[56] References Cited

FOREIGN PATENT DOCUMENTS

| | | | |
|---|---|---|---|
| 0169876 | 9/1984 | Japan | 400/120 |
| 0031269 | 2/1986 | Japan | 346/76 PH |
| 0286170 | 12/1986 | Japan | 400/120 |
| 0290070 | 12/1986 | Japan | 346/76 PH |
| 0033658 | 2/1987 | Japan | 346/76 PH |
| 0214971 | 9/1987 | Japan | 400/120 |

*Primary Examiner*—Benjamin R. Fuller
*Assistant Examiner*—Huan Tran
*Attorney, Agent, or Firm*—Frishauf, Holtz, Goodman & Woodward

[57] ABSTRACT

An apparatus for transferring an ink pattern image from a thermal transfer medium having an ink layer onto an image receiving medium. The thermal transfer medium is pressed against the image receiving medium and is conveyed together with the image receiving medium to a printing head and to a separating roler, in that order. A heater is provided to heat the thermal transfer medium so that it is at a given temperature when it is separated from the image receiving medium.

18 Claims, 5 Drawing Sheets

THERMAL TRANSFER RECORDING APPARATUS FOR CONTROLLING PRINTING DENSITY WITH THE TEMPERATURE AT THE POSITION WHERE THE INK RIBBON AND PAPER ARE SEPARATED

BACKGROUND OF THE INVENTION

The present invention relates to a thermal transfer recording apparatus.

Thermal transfer recording is defined as a recording system in which ink of a thermal transfer recording medium such as a ink ribbon or an ink sheet is transferred and recorded onto a image receiving medium such as a recording paper by the heat of a thermal recording head which will be merely called a head hereinafter. This recording system can be divided into two main classes of a serial system and line system. In the serial type of thermal transfer recording system, recording is conducted as follows: in the head, a plurality of heating elements, for example 24 heating elements, are arranged in the direction of recording paper feeding, wherein the length of the arranged heating elements is equal to the width of a line of printed characters; while the head is moved in the direction perpendicular to the recording paper feeding direction, a line of characters are printed on a recording paper through an ink sheet or ribbon; then the head is withdrawn to the initial position synchronously when the recording paper is moved to the position of the next line; and the next printing operation is started. In the line type of recording system, operations are conducted as follows: in the case that the head is not moved; in the head, a plurality of heating elements, for example 2000 heating elements, are arranged in a line in the direction perpendicular to the recording paper moving direction; and while the recording paper and ink sheet are being moved, printing of a line of characters is conducted dot by dot in the direction vertical to the recording paper moving direction.

The ink ribbon or ink sheet is usually provided in a cassette in such a manner that: it is wound around a supply reel or supply shaft; and the leading edge is mounted on a take-up reel or shaft, so that when the take-up reel or shaft is rotated, the ink ribbon or ink sheet travels.

There are two kinds of ink ribbon or ink sheet, one is a one-time ink ribbon or sheet which can be used only once, and the other is a pluraltime repeatable ink ribbon or sheet which can be used a plurality of times. The pluraltime repeatable ink ribbon or sheet can be repeatedly used until its availability is used up, so that it is convenient compared with the one-time of ink ribbon or ink sheet since the number of exchange of the exhausted ink ribbon or ink sheet can be reduced. However, there are following problems.

FIG. 10 is an enlarged sectional view of the head and the portion close to the head in the case of the line system.

The head 84 is composed as follows. A heating element layer 86 made of tantalum nitride is provided on an alumina base 91 supported by an aluminum base 92; a common electrode 87 is provided to one edge of the heating layer 86 in the direction vertical to the surface of the drawing; a plurality of individual electrodes 88 are provided to the other edge in the direction vertical to the surface of the drawing; and the surface of the head is covered by a protective layer 89 made of an abrasion-resistant material such as silicon nitride.

A heating portion 84*a* is formed in the position where the common electrode 87 and individual electrodes 88 are spaced and opposed to each other. When an electric signal is selectively impressed upon the individual electrodes 88 by an IC for driving use not shown in the drawing, the heating portion 84*a* is heated dot by dot, so that ink 80*c* is transferred from an ink sheet 80 onto a recording paper 85 dot by dot.

The ink sheet 80 is composed of an ink layer 80*a* and a film 80*b* made from polyethylene terephthalate (PET) which supports the ink layer 80*a*. The ink sheet 80 comes into contact with the head on the side of the film 80*b*. The recording paper 85 is contacted with the ink layer 80*a* on the ink sheet 80 and pressed against a platen 90A by the press force of the head 84. When the heating portion 84*a* is selectively heated, the ink layer 80*a* on the ink sheet 80 is transferred onto the recording paper 85 dot by dot. In the case of a pluraltime repeatable type of ink sheet, only a portion of the ink layer 80*a* comes off in the position where transfer is performed, so that a cut-out portion 80*d* is formed in the ink layer 80*a*.

In a conventional recording apparatus, printing density is controlled so that it can be kept constant in such a manner that: a thermometer is provided to the head; and energy supplied to the heating portion of the head is adjusted in accordance with the measured temperature. Otherwise, printing density is controlled in such a manner that: an information of the operation of turning on and off conducted in the previous dot and in the dot before previous one, is memorized and energy supplied to the heating portion of the head is adjusted in accordance with the stored history.

However, in the case of a pluraltime repeatable type of ink sheet, only a portion of ink is transferred onto a transfer paper in a one-time printing operation, so that the amount of ink transferred onto the paper depends on the energy supplied by the head as well as the temperature condition of a separating portion 22. Accordingly, it is impossible to obtain uniform printing quality by the conventional method in which energy supplied to the head is only controlled.

SUMMARY OF THE INVENTION

It is a primary object of the present invention to provide a thermal transfer recording apparatus which is characterized in that: printing density is always constant with no relation to the variation of environmental temperature, and printing quality is high.

The present invention is to provide a thermal transfer recording apparatus in which a thermal transfer recording medium available a plurality of times is used and a recording pattern is transferred onto a recording sheet while the thermal transfer recording medium is moved together with a recording sheet, and which is characterized in that: a heating means, which facilitates the progress of transfer, is provided in a position where the above-described thermal transfer recording medium and recording sheet are separated from each other, or provided in a position located upstream with regard to the above-described position, so that a certain temperature is provided at the separation position.

BRIEF DESCRIPTION OF THE DRAWINGS

FIG. 1 is a schematic front view showing the main portion inside the thermal transfer recording apparatus of the present invention;

FIG. 2 is a schematic front view showing the main portion inside the thermal transfer recording apparatus of another example;

FIG. 3 is a partially enlarged view of FIG. 2;

FIGS. 4, 5, 6, 7, 8 and 9 are respectively schematic front views showing the inside of the thermal transfer recording apparatuses of other examples.

DETAILED DESCRIPTION OF THE EMBODIMENT

Examples of the present invention will be explained as follows.

As a result of the investigation conducted by the inventors, it has been found that the above-described problems can be solved by heating an ink sheet between the position where printing is conducted and the position where the ink sheet is separated from a recording paper. The present invention has been accomplished according to the knowledge described above.

The following are the examples in which the present invention is applied to a line type of thermal transfer recording apparatus.

Figure 1:
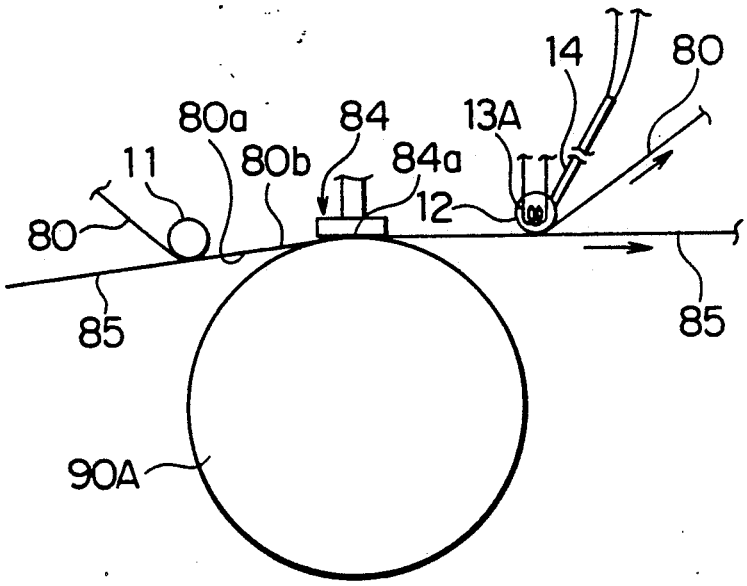
FIG. 1 to FIG. 9 show the examples of the present invention.
Figure 10:
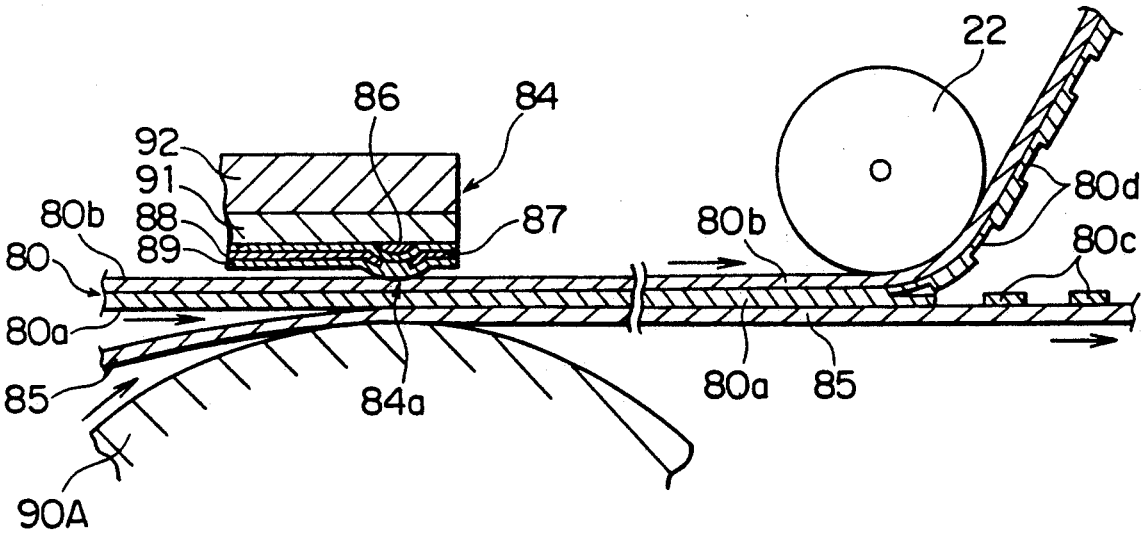
FIG. 10 is an enlarged sectional view of the main portion of a conventional thermal transfer recording head by which thermal transfer recording is being conducted, and of other units around the head.

FIG. 1 is a schematic front view showing the main portion of an example in which a roller for ink sheet separation located in a downstream position of the head, is heated in order to heat the ink sheet when the ink sheet is separated from a recording sheet. Like parts in each of FIG. 1 and FIG. 10 are identified by the same reference character, which is the same in other cases described later.

An ink sheet 80 is pressed against a recording paper 85 by a guide roller 11 and moved to a head 84 together with the recording paper 85. In the position where a heating portion 84*a* of the head 85 is located, the recording paper 85 and head 84 are pressed against a platen 90A by the head 84 so that printing is conducted as described before. After printing, the ink sheet 80 is separated from the recording paper 85 by an ink sheet separation roller 12, which will be merely called a separation roller hereinafter. A heater 13A is incorporated in the separation roller 12, and the ink sheet 80 is heated when the ink sheet 80 is separated from the recording paper 85. The temperature of the separation roller 12 is controlled, so that the amount of ink transferred from the ink sheet 80 to the recording paper 85 becomes approximately constant. Accordingly, as described above, the fluctuation of print density is actually eliminated, so that printing of high quality can be accomplished.

When the above-described heating temperature is 10–120° C, the above-described effect can be obtained. The most preferable heating temperature is in the range of 20°–80° C. The temperature of the separation roller 12 is detected by a thermocouple 14, and controlled by a control unit not illustrated in the drawing. In order to make the above-described temperature control easy in such a manner that the temperature of the separation roller 12 is not raised excessively high, the heater 13A is composed as follows: a heating element and a PTC (positive temperature coefficient) thermistor (for example, posistor, a brand name of thermister) are connected in series, which is the same in other examples. A PTC thermistor has such a characteristic that the resistance is suddenly increased when it is heated above a fixed temperature. Due to the increase in resistance, power supplied to the heating element is restricted so that an excessive increase in the temperature of separation roller 12 can be prevented. Although a ceramics heating element is preferably used for the heating element of the separation roller 12, other heating elements (metallic heating elements) may be used.

Figure 2:
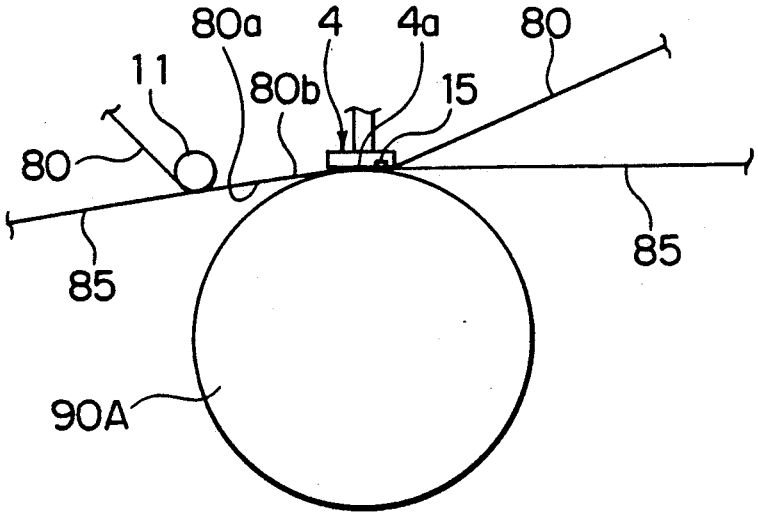
Figure 3:
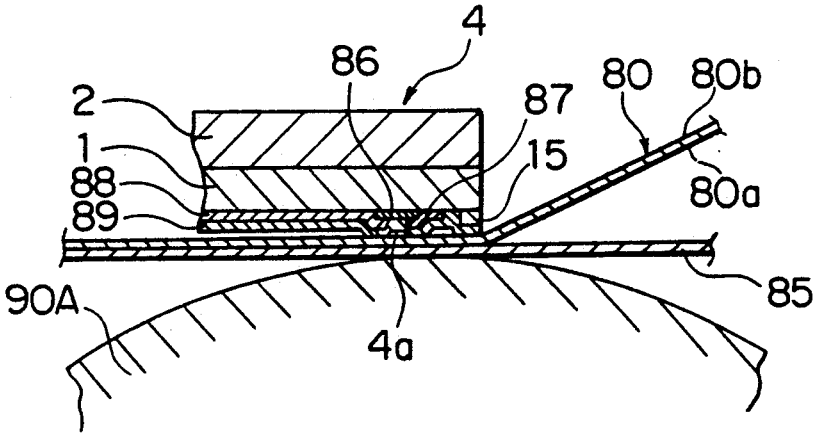

FIG. 2 is a schematic front view of the main portion showing an example in which another heating element than the heating element for printing is provided to the head and an ink sheet right after printing is heated by the above-described heating element. FIG. 3 is a partially enlarged view of FIG. 2.

A head 4 used in this example has nearly the same structure as the head illustrated in FIG. 10, wherein a heating element layer 15 is provided to the edge portion of the head on the downstream side with regard to the movement of the ink sheet. Therefore, a base plate 1 made of alumina and a base plate 2 made of aluminum are made a little wider for the downstream side of the ink sheet.

After the ink sheet 80 has conducted printing in a heating portion 4*a* of the head 4, it is heated by the heating layer 15. Then, the ink sheet 80 is bent upward as shown in FIG. 3 at the tip of the heating layer 15, and separated from a recording paper 85. In this example, a separation roller is not necessary. Other points are the same as the example shown in FIG. 1.

Figure 4:
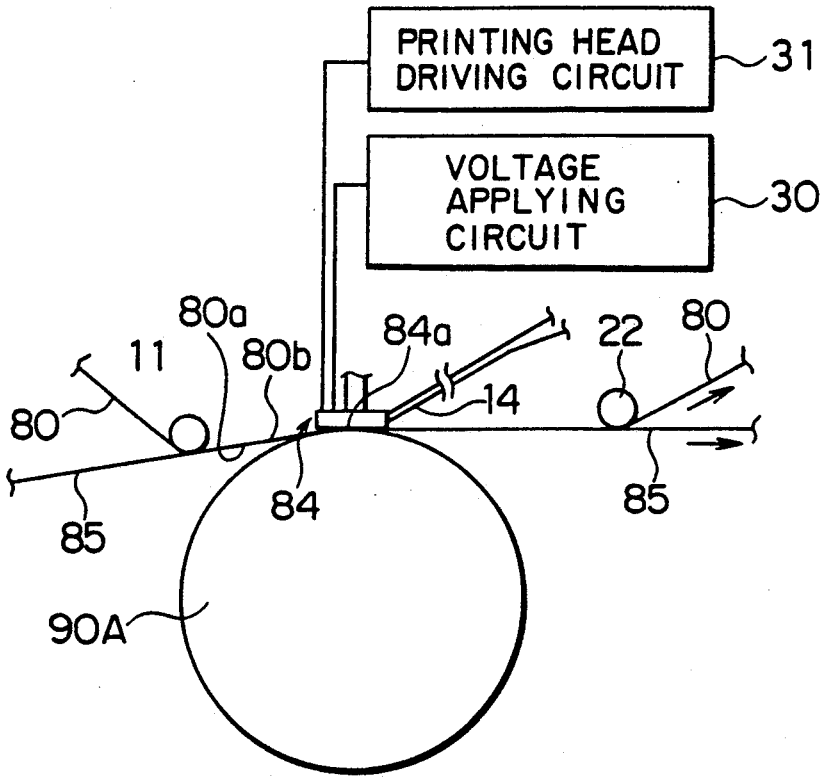

FIG. 4 shows an example in which a heating portion 84*a* of a head 84 is also utilized to heat the entire ink sheet separately from heating for printing.

In this example, while an ink sheet 80 and recording paper 85 are stopped, a voltage impressing circuit 30 is activated so that energy can be given to the entire heating portion 84*a*, wherein the amount of energy is not so large that the ink is melted. In this manner, the temperature of the entire thermal head base is increased, and as a result, the temperature of the ink sheet 80 is increased. Right after that, a printing head drive circuit 31 is activated, and energy is selectively given to the heating portion 84*a* so that printing is conducted. Then, the ink sheet 80 and recording paper 85 are stepped ahead. In the way described above, the temperature of the ink sheet 80 is maintained to a predetermined temperature, so that the same effect as the examples in FIGS. 1 to 3 can be obtained.

In the examples shown in FIGS. 1 to 4, the ink sheet is directly heated. In the examples in FIGS. 5 to 9 which will be explained later, the environmental temperature inside the recording apparatus is raised in order to increase the temperature of an ink sheet in the region between a head heating portion (a printing portion) and a separation roller 22. It is preferable that the above-described environmental temperature is kept in the range of 10°–60° C.

Figure 5:
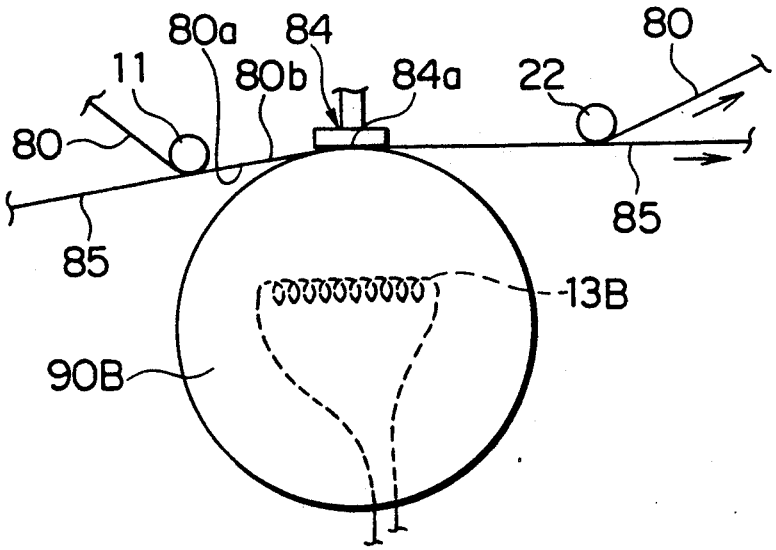

In the example shown in FIG. 5, a heater 13B is incorporated in a platen 90B. The fluctuation of printing density is actually eliminated as follows: the heater 13B is energized in order to raise the temperature of the platen 90B, so that the environmental temperature inside the recording apparatus is raised; and as a result, the temperature of an ink sheet 80 is raised, so that the fluctuation of printing density can be substantially eliminated in the same way as the above-described examples.

In the drawing, the numeral 22 is a separation roller in which a heater is not incorporated.

Figure 6:
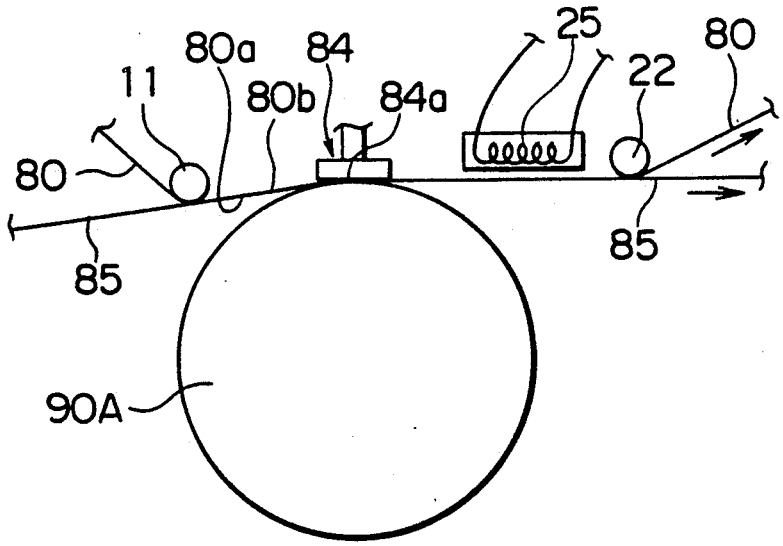

In the example shown in FIG. 6, a heater 25 is arranged on the ink sheet 80 side between a head 84 and a separation roller 22. The heater 25 is not contacted with the ink sheet 80. The heater 25 has the function to directly heat the ink sheet 80. However, it can be noted that the heater 25 rather raises the environmental temperature inside the recording apparatus so that the temperature of the ink sheet 80 is indirectly raised, and the fluctuation of printing density is actually eliminated in the same manner as the above-described examples.

Figure 7:
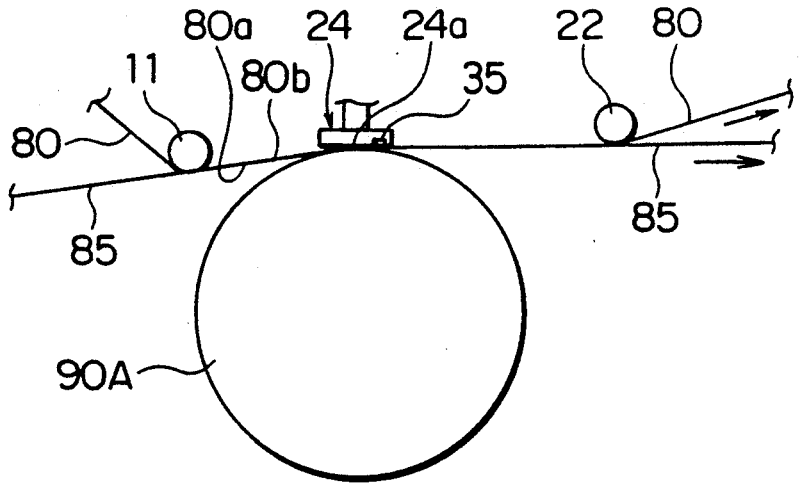

In the example shown in FIG. 7, the area of a head 24 on the downstream side is made larger than the head 4 illustrated in FIG. 2 and FIG. 3, and a wide heating element layer 35 is mounted on this portion. When the heating element layer 35 is energized, the environmental temperature inside the recording apparatus is raised, so that the temperature of an ink sheet 80 is raised and the fluctuation of printing density is actually eliminated.

In all of the above-described examples, the ink sheet 80 is heated while it is in the region between the head 24 and the separation roller 22. The essential point is that the temperature of the ink sheet 80 is sufficiently high when the ink sheet 80 is separated from the recording paper 85. Consequently, the ink sheet heating means may be provided on the upstream side with regard to the head 24 as far as the above described condition can be satisfied.

Figure 8:
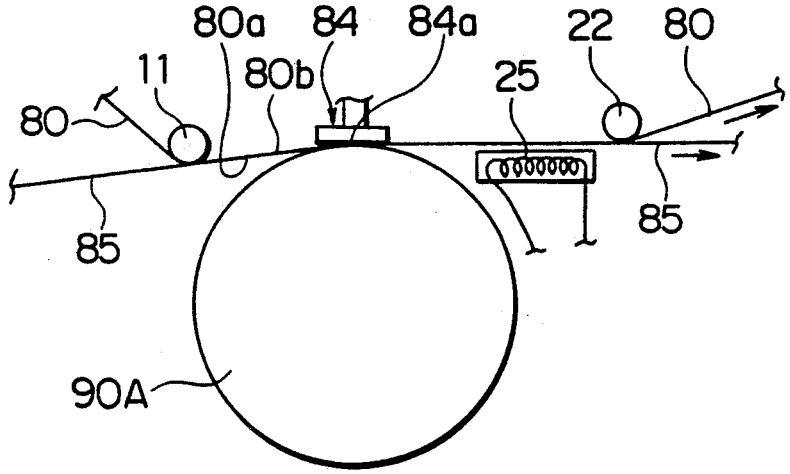

In the example shown in FIG. 8, the heater 25 is provided between the heating portion 84*a* of the head 84 and the separation roller 22 at the recording paper 85 side in the same manner as the example shown in FIG. 6; the environmental temperature is raised by energizing the heater 25; and the temperature of the ink sheet 80 is raised in the way described above, and the fluctuation of printing density is actually eliminated. The heater 25 may be provided on both sides, one is on the recording paper 85 side and the other is on the ink sheet 80 side, so that the ink sheet can be directly and indirectly heated by two heaters.

Figure 9:
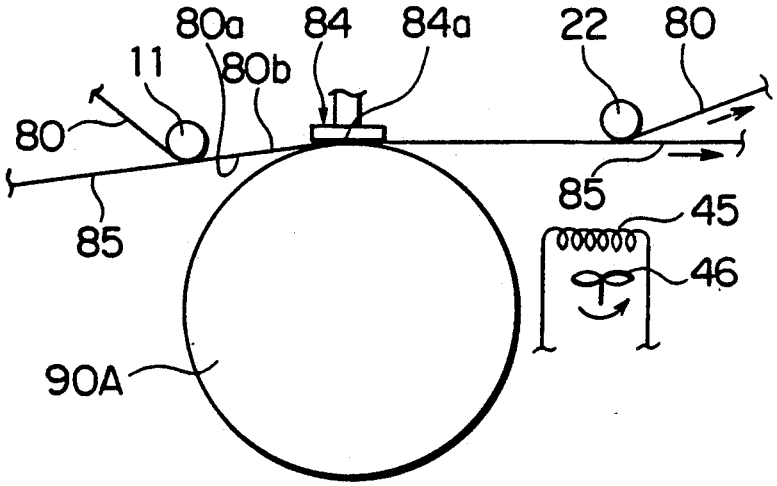

In the example shown in FIG. 9, instead of the heater 25 shown in FIG. 8, the heater 45 and the fan 46 placed behind the heater are provided so that hot air can be blown to the recording paper 85 in order to raise the environmental temperature inside the recording apparatus. The structure of other portions is the same as the example shown in FIG. 8.

In the examples illustrated in FIG. 8 and FIG. 9, the heater 25, heater 45 and fan 46 may be provided in other appropriate positions.

In the examples described above, a complicated control unit is not necessary, so that the manufacturing cost of the recording apparatus can not be excessively increased.

The examples of the present invention have been explained above. As many apparently widely different embodiments of this invention may be made without departing from the spirit and scope thereof. For example, one kind of ink sheet heating means is provided in the examples shown in FIG. 1 to FIG. 9. However, not less than two kinds of ink sheet heating means may be provided. For example, the following structure may be adopted: the heater 13A shown in FIG. 1 is incorporated in the separation roller 22; and at the same time, the heater 45 and fan 46 shown in FIG. 9 or other heating means may be provided, or other heating means may be appropriately combined. Further, instead of the rotating separation rollers 12, 22, separation members such as a separation blade and separation table may be used. Furthermore, in order to raise the environmental temperature inside the recording apparatus, heat insulating materials may be applied to the surface of the platen, the separating members and the material for the recording paper so that the environmental temperature can be effectively raised.

In the above-described examples, the present invention is applied to the line type of thermal transfer recording apparatus. It is a matter of course that the same effects can be provided when the present invention is applied to a serial type of thermal transfer recording apparatus.

In the apparatus of the present invention, a heating means to facilitate transfer is provided in the position where a thermal transfer recording medium and recording sheet are separated from each other or/and in the upstream position with regard to the relative movement of the thermal transfer recording medium. Accordingly, when the temperature is controlled by the above-described heating means, the transfered amount of ink from a thermal transfer recording medium to a recording sheet can be maintained constant with no relation to the conditions of the previous thermal transfer recording and the environmental temperature inside the apparatus. Consequently, the result obtained by the recording is always so excellent that the fluctuation of density is actually eliminated. The amount of ink transfered from the thermal transfer recording medium can be controlled to a desired value and a desired recording density ca be obtained by controlling the above-described heating temperature.

What is claimed is:

1. An apparatus for transferring an ink pattern image from a thermal transfer medium having an ink layer onto an image receiving medium, comprising:

conveying means for pressing said thermal transfer medium against said image receiving means and for conveying said thermal transfer medium in a conveying direction together with said image receiving medium pressed against said thermal transfer medium first to a printing means and then to a separating means;

wherein said printing means applies heat to said thermal transfer medium in positions corresponding to said ink pattern;

heating means for heating said thermal transfer medium as said thermal transfer medium is pressed against said image receiving medium; and wherein said separating means separates said image receiving medium from said thermal transfer medium so as to transfer said ink pattern image from said thermal transfer medium to said image receiving medium.

2. The apparatus of claim 1, wherein said separating means includes a roller, and wherein said heating means is incorporated in said roller.

3. The apparatus of claim 1, wherein said heating means is disposed between said printing means and said separating means.

4. The apparatus of claim 1, wherein said printing means includes a thermal head in which there are provided heating elements for applying heat corresponding to said ink pattern image, and wherein said heating means is provided in said thermal head.

5. The apparatus of claim 4, wherein said heating means is disposed downstream of said heating elements with regard to the conveying direction of said conveying means.

6. The apparatus of claim 1, wherein said heating means provides a heating temperature of 10° to 120° C.

7. The apparatus of claim 6, wherein said heating means provides a heating temperature of 20° to 80° C.

8. The apparatus of claim 6, wherein said heating means comprises means for detecting said heating temperature and means for controlling said heating temperature.

9. The apparatus of claim 1, wherein said heating means comprises a heating element and a positive temperature coefficient thermistor.

10. An apparatus for transferring an ink pattern image from a thermal transfer medium having an ink layer onto an image receiving medium, comprising:

conveying means for pressing said thermal transfer medium against said image receiving medium and for conveying said thermal transfer medium in a conveying direction together with said image receiving medium pressed against said thermal transfer medium first to a printing means and then to a separating means;

wherein said printing means applies heat to said thermal transfer medium in positions corresponding to said ink pattern;

heating means for heating said thermal transfer medium to produce a given temperature condition in said thermal transfer medium at said separating means; and wherein said separating means separates said image receiving medium from said thermal transfer medium so as to transfer said ink pattern image from said thermal transfer medium to said image receiving medium.

11. The apparatus of claim 10, wherein said separating means includes a roller, and wherein said heating means is incorporated in said roller.

12. The apparatus of claim 10, wherein said heating means is disposed between said printing means and said separating means.

13. The apparatus of claim 10, wherein said printing means includes a thermal head in which there are provided heating elements for applying heat corresponding to said ink pattern image, and wherein said heating means is provided in said thermal head.

14. The apparatus of claim 13, wherein said heating means is disposed downstream of said heating elements with regard to the conveying direction of said conveying means.

15. The apparatus of claim 10, wherein said heating means provides a heating temperature of 10° to 120° C.

16. The apparatus of claim 15, wherein said heating means provides a heating temperature of 20 to 80° C.

17. The apparatus of claim 15, wherein said heating means comprises means for detecting said heating temperature and means for controlling said heating temperature.

18. The apparatus of claim 10, wherein said heating means comprises a heating element and a positive temperature coefficient thermistor.

* * * * *